US005156536A

United States Patent [19]

Wilson

[11] Patent Number: 5,156,536

[45]. Date of Patent: Oct. 20, 1992

[54] SAFETY HAND PUMP

[76] Inventor: Robert G. Wilson, 411 S. Railroad St., Oak Harbor, Ohio 43449

[21] Appl. No.: 588,371

[22] Filed: Sep. 26, 1990

[51] Int. Cl.[5] ..... F04B 21/08

[52] U.S. Cl. ..... 417/572; 222/385; 222/189; 285/357; 285/341; 285/336

[58] Field of Search ..... 417/572; 222/383, 385, 222/189; 285/357, 341, 336

[56] References Cited

U.S. PATENT DOCUMENTS

| | | | |
|---|---|---|---|
| 629,332 | 7/1899 | Bouhon . | |
| 987,583 | 3/1911 | Long . | |
| 2,336,989 | 12/1943 | Kelleher et al. | 417/554 |
| 3,462,539 | 8/1969 | Winston | 285/357 |
| 3,473,479 | 10/1969 | Sundholm | 103/218 |
| 3,635,669 | 1/1972 | Rubin | 423/158 |
| 3,743,448 | 7/1973 | Dorn | 417/570 |
| 3,820,800 | 6/1974 | Dorn | 277/237 |
| 4,265,375 | 5/1981 | Flider | 417/554 |
| 4,275,860 | 6/1981 | Brabazon | 137/234.6 |
| 4,403,926 | 9/1983 | Stamper | 417/553 |
| 4,593,940 | 6/1986 | Wilder | 285/341 |
| 4,717,473 | 1/1988 | Burge et al. | 166/147 |

*Primary Examiner*—Richard A. Bertsch
*Assistant Examiner*—Charles G. Freay
*Attorney, Agent, or Firm*—Jerry Semer

[57] ABSTRACT

This invention is a small hand piston type pump design to pump small quanity of flammable liquids safely from a drum. The pump has a grounding clip, and a bonding clip attached and a metal bung adapter to ensure that static build up during the pumping process is adequately grounded from not only the pump but the vessel into which the liquid is being pumped and the drum. The pump also contains a flame arrestor in the spout and a check ball and a strainer in the pickup tube to ensure that a fire within the pump will not extend into the drum and a strainer in the pickup tube to further arrest any flames. The pump is made out of carbon steel, glass and teflon so that the parts have good chemical resitance and are long lasting. The pump has a sealing device design for longjevity. This sealing device has a packing gland whose edges are beveled. It fits into a conically channel between the packing head and packing nut and when the packing nut is tighten the packing gland is forced towards the shaft.

10 Claims, 3 Drawing Sheets

SAFETY HAND PUMP

The Present invention relates to an improved hand pump of the type used in connection with barrels or drums containing fluids and flammable liquids.

BACKGROUND OF THE INVENTION

Today many small businesses deal with small quantities of flammable liquids. Usually these flammable liquids are shipped to the small companies in drums that contains larger quantities of the liquid than the small companies can use at one time. Therefore, these flammable liquids usually have to be pumped out of the larger drums into a smaller container. The pumping of these liquids into the small containers is very hazardous. In fact the inventor began work on this invention after reading an article on a man who died in a fire which was caused by the pumping of the flammable liquids hazardously.

Pumps that are built to pump small quantities of liquid are extremely unsafe when pumping flammable liquids. If any of the liquids after it has been pumped out catches on fire there is a real problem with the pumps in prior art of the fire spreading up through the spout of the pump due to vapors in that spout and then continuing to spread through the pumps into the drum setting the whole drum on fire and probably causing an explosion. Also, pumps in the prior art cause fires themselves. Static electricity is built up in the pumping actions and this static electricity could cause a spark igniting the flammable liquids. Thus, the object of this invention is to create a pump that can pump flammable liquids safely with out a fear of fire or explosion. The feature that achieved this objective are that the pump is equipped with a grounding clip, bonding clip, metal bund adapter, ball check valve, pick up tube and flame arrester. Another objective is to create a pump that can pump all type of flammable liquids including lacqure thinner. Lacqure thinner quickly deteriorate most material used in the pump. The feature that achieved this objective is that the pump parts are made out of carbon steel, glass and teflon brand polytetrafluoroethylene; teflon is a trademark of E.I. duPont de Nemours & Co., Wilmington, Del. Further objective is to make a pump that is long lasting. The feature that achieved this objective is a specialty designed packing gland. The above stated features give the pump a large number of advantages. First, this is a safety pump that an individual can use to pump small quantities of flammable liquids with out the fear of a fire spreading into the drum, nor the fear of static build up which could cause a spark that leads to fire. Secondly, this pump has great advantage over the prior art in that it can pump a great numbers of different liquids including lacqure thinner. Further, this pump has advantage over other hand operated pumps in the prior art in it longevity due to it special packing gland.

SUMMARY OF THE INVENTION

This invention is a hand pump with several built in safety features. The safety hand pump is designed to pump small quantity of flammable liquids with out the fear of fire spreading into the drum nor the fear of static build up which would cause the spark which could and lead to a fire. The pump is a small piston type pump design to pump small quanity of liquids safety from a drum. The pump has a grounding clip, and a bonding clip attached and a metal bung adapter to ensure that static build up during the pumping process is adequately grounded from not only the pump but the vessel into which the liquid is being pumped and the drum. The pump also contains a flame arrestor in the spout and a check ball to ensure that a fire within the pump will not extend into the drum and a strainer in the pickup tube to further arrest any flames. The pump is made out of carbon steel, glass and teflon brand polytetrafluoroethylene; teflon is a trademark of E.I. duPont de Nemours & Co., Wilmington, Del. so that the parts have good chemical resitance and are long lasting. At the top of the pump barrel where the shaft of the pump enter the pump barrel, the sealing device of pump this has been designed for longevity. The sealing device consist of a packing head attached to the barrel of the pump which has a conically shaped chamber which the packing gland fits against. The packing nut also has a conically shaped channel which fits against the upper portion of the packing gland. These connicly shaped channels are cut on a 30 degree angle to a line running through the center of the packing nut and packing head. When the packing nut is tighten against the packing gland this connic channel pushes on the packing gland toward its center, where the shaft runs through the packing gland. Thus by tighten down the nut, the seal of the packing gland against the shaft becomes tighter.

DETAILED DESCRIPTION OF THE PREFERRED EMBODIMENT

Figure 1:
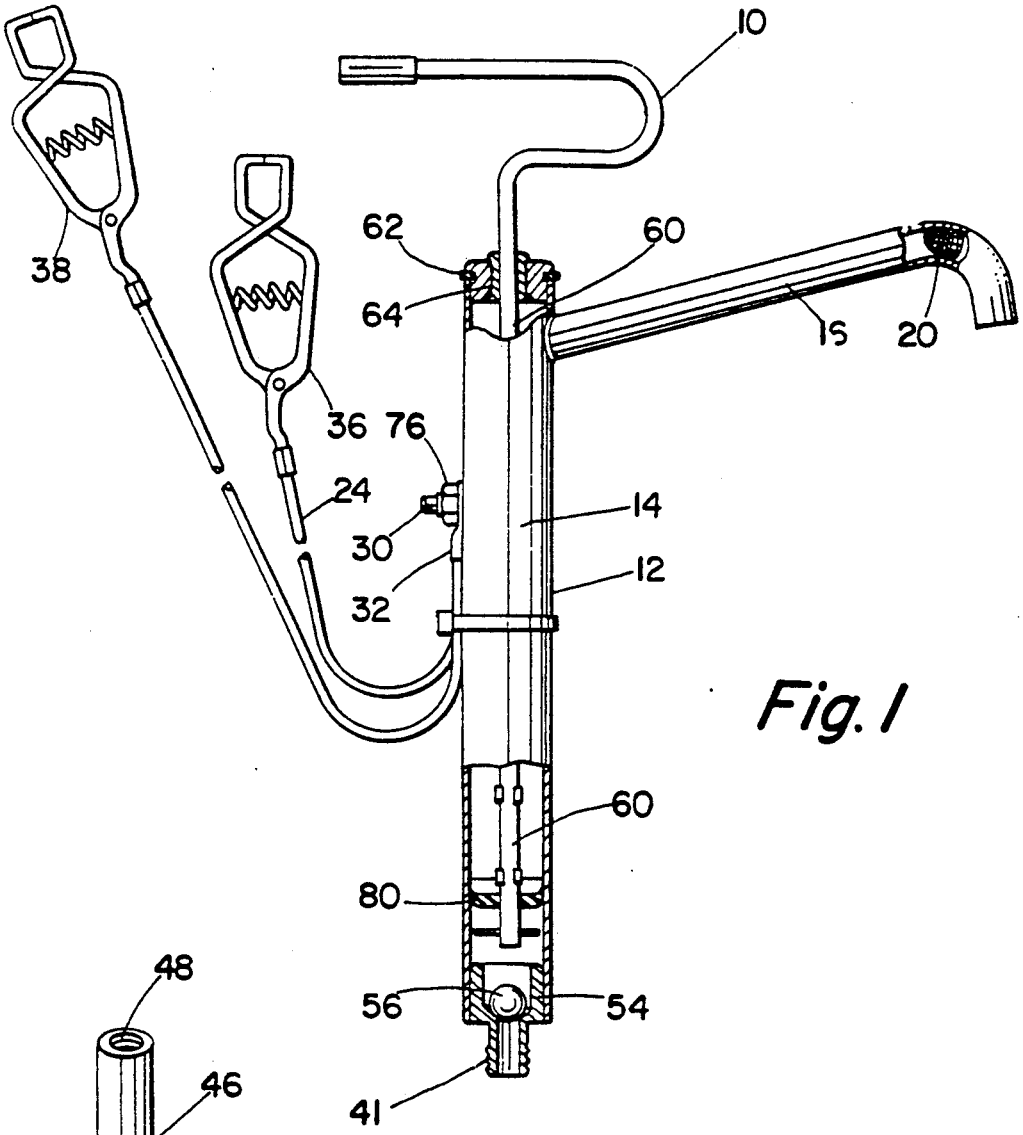
FIG. 1. Is a view of the pump showing in phantom the flame arrestor, the strainer, and the check valve with ball.
Figure 4:
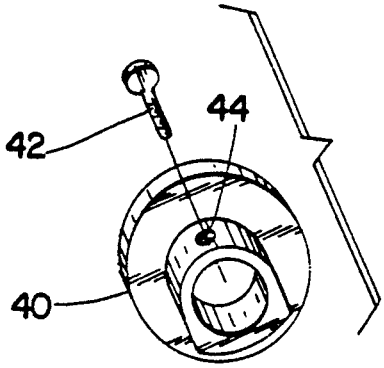
FIG. 4. Shows the bung adapter.
Figure 2:
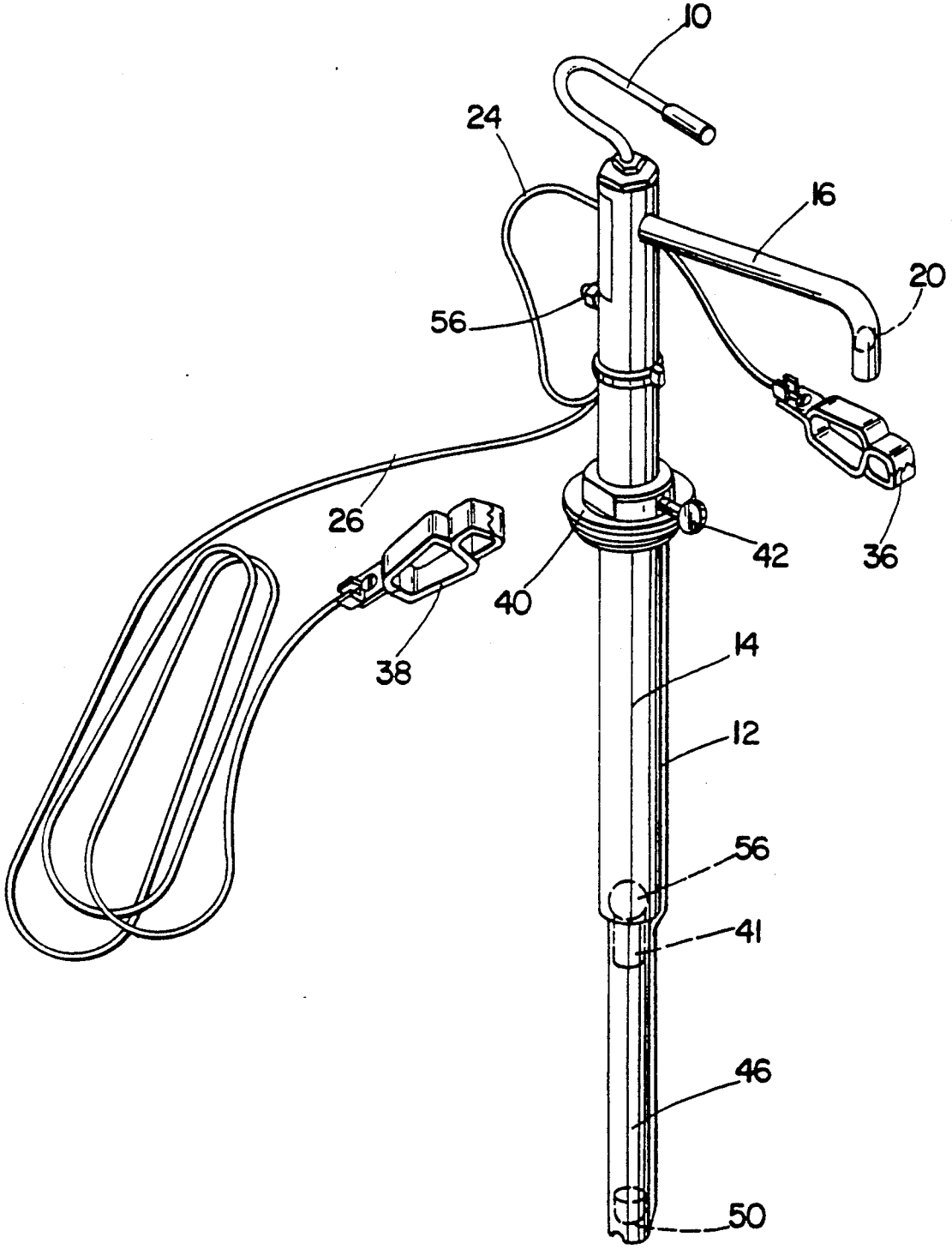
FIG. 2. Is a cut away view of the pump with cut away showing the packing nut, head and gland, the flame arrestor in the pumps spout, the check valve, and the piston.

This invention is a hand operated piston pump which is constructed to pump a small amount of liquid from a drum. FIG. 1 is a detailed drawing of the pump 14. The handle 10 extends out of the top of the barrel 12 of the pump. The handle 10 is P shaped for easy pumping. Also extending out of the barrel 12 near the top of the barrel 12 is the spout 16 of the pump 14. In the spout 16, very near the end of the spout 16, is a flame arrester 20. This flame arrester 20 is to keep any spark or fire from igniting the gasses in the spout 16 and spreading down into the drum 18 containing large quanities of the flammable liquids. As one goes farther down the barrel 12 of the pump 14 we find a ground wire 26 and a bonding wire 24 attached to the barrel 12 of the pump 14. In the perfered embodiment a threaded stud 30 is welded to the barrel of the pump 14. The terminal connectors 32 and 34 are placed over the threaded stud 30 and they are held in place by a lock nut 76. On the ends of the bonding wire and the grounding wire 26 are clamps 36 and 38 for attachment to metal surfaces. The bonding wire 24 and the grounding wire 26 could be attached to the pump 14 by soldering, welding, or many other ways known in the art. The bonding and the grounding wires 24 and 26 and clamps 36 and 38 are design to prevent static build up. In operation you would attach the bonding clamp 36 to bare metal on the receiving container. One then attachs the grounding wire 26 to a proper ground. Since the pump 14 and the bung adapter 40 is made out of a conductive material any static build up on the container from which you are pumping conducts through the bung adapter 40 to the pump 14 and to the grounding wire 26 and down into to ground. Also any static build up on the receiving container will be conducted through bonding clamps 36 and bonding wire 24 to the grounding wire 26 and into the ground. Any static build up on the pump will travel through the grounding wire 26 into the ground. This eliminates the possibilty of a spark caused by static built up. It should also be noted that in the preferred embodiment the grounding clamps 36 and the bonding clamps 38 are heavy duty clamps so that when they are attached they will chip away or scratch away at the paint to get a good connection. As we go further down in the barrel 12 of the pump 14 we come to the bung adapter 40. The bung adapter 40 is adapted to fit into a bung on the top of the container to be pump from. In the preferred embodiment the bung adapter 40 is threaded to fit into a container whos bung is threaded. The bung adapter is shown in FIG. 4. From this figure you can see that the bung adapter 40 has an opening adapted to fit the barrel 12 of the pump through. The pump 14 is secured to the bung adapter 40 by a thumb screw 42 that passes through a threaded opening 44 in the bung adapter 40 and is tighten against the barrel 12 of the pump 14. The opening in the bung adapter 40 for the pump is sufficiently large to allow the pump 14 to be placed through it and to be turned when the pump 14 is in the adapter 40. Therefore, the user of the pump 14 can position the spout 16 in any position and tighten it in that position by use of the thumb screw 42.

In the prefered embodiment the bung adapter is made from metal. However, any conducting substances can be used to make the bung adapter. The conductive bung adapter is one of the safety features of the pump. Since the bung adapter is conductive it can carry any static electricity that builds up in the container being pumped from to the pump 14 and since the pump 14 is also conductive this static electric will flow through the pump to the ground wire 26 grounding the pump 14.

Figure 3:
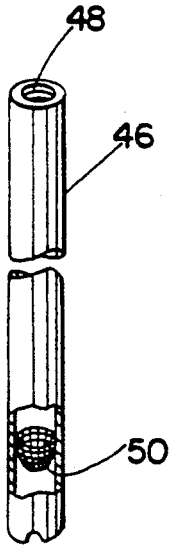
FIG. 3. Shows the pickup tube with the cut away showing the strainer.

As shown in FIG. 3 a pick up tube 46 passes out of the bottom of the barrel 12 of the pump 14. This pick up tube is cylinderical and smaller in diameter than the barrel 12 of the pump 14. In the perfered embodiment the pick up tube 46 is attach to the barrel 12 of the pump 14 by a threaded end plug 48. The pick up tube however could be welded or attach by numereous other methods known in the art. The pick up tube 46 is shown in FIG. 3. Near the bottom end of the pick up tube 46 on the inside of the tube is a strainer 50. The strainer 50 strains out debris that may be contain in the liquid being pumped out of the container.

The strainer 50 also acts as a flash suppressor in the case where the drum is almost empty, but still could have flammable or explosive fumes in the container. Thus, if a fire started in the pump it would not spread past the strainer 50 and explode the fumes in the drum.

At the bottom end of the barrel 14 is a nipple 41. In the preferred embodiment the nipple is threaded and is adapted to allow the end plug 48 of the pickup tube 46 to be attached to it. Above this nipple 41 on the inside of the barrel 12 is a check valve 54. In the preferred embodiment this check valve 54 is a ball type check valve. The check valve 54 is a ball 56 that seats on the opening 58 at the bottom of the barrel 12 of the pump 14. This check valve 54 is one of the safety feature of the pump. This ball 56 insures that if the liquid being pumped catches on fire within the pump 14, that fire will not spread past the ball 56 and into the container from which the liquid is to be pumped. The ball 56 in the preferred embodiment is made out of glass to ensure long life and resistance to the chemicals being pumped.

Figure 5:
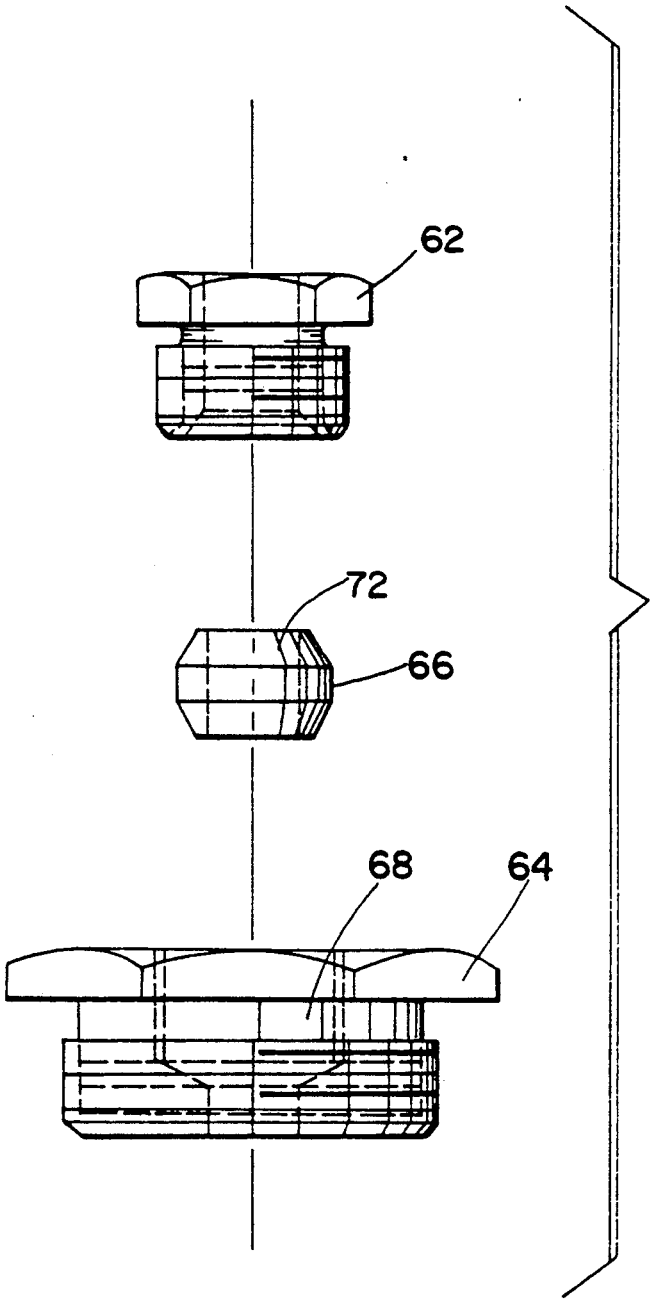
FIG. 5. Shows the packing head, the packing gland and the packing nut.

The handle 10 is attached to a shaft 60 that passes into the barrel 14 of the pump 10 through a sealing means at the top of the barrel 14 of the pump 10. The sealing means of the preferred embodiment is showing in FIG. 5. The sealing means comprised of a packing nut 62, a packing head 64 and a packing gland 66. The packing head is attached to the top of the barrel 12 and has a opening 68 in its center. At the bottom of the opening 68 of the packing head 64, the opening 68 is just a little bit larger in diameter than the pump shaft 60. The top portion of the opening 68 is of a size large enough that the packing gland 66 can fit with in the opening 68. Between the packing gland size opening and the shaft opening is a channel with conic sides 70. In the preferred embodiment these connic sides 70 are at a 30 degree angle from a line running through the center of the opening 68. The packing gland 54 in the preferred embodiment is circular in shape and has a opening 62 in the center which has a diameter nearly the same as the diameter of the shaft 60 of the pump 14. The top edge 74 and the bottom edge 70 of the packing gland 66 are cut or beveled at an angle of 30 degrees from a line running parallel with the side of the packing gland 66. The packing gland 66 in the preferred embodiment is made out of teflon brand polytetrafluoroethylene; teflon is a trademark of E.I. duPont de Nemours & Co., Wilmington, Del. because of it resistence to chemicals. The packing gland 66 however, could be made out of rubber, cloth, plastics or other substances that are used for gaskets. The packing nut 62 in the preferred embodiment has a hex head. However, this nut could have a screw type head or other shaped of nut heads known in the art. The bottom portion of the packing nut 62 is threaded and is adapted to fit the threads of the packing head 64. The packing nut 62 also has cylinderical channel passing through the center of the packing nut 62 and the channel is of a diameter slightly larger than the shaft 60 of the pump 14. This channel at the bottom is conically shaped tapering towards the top of the nut on an angle of 30 degrees from a line that is runs through the center of the channel.

In operation the packing head 64 is placed over the shaft and attached to the barrel of the pump. In the preferred embodiment the packing head 64 has threads that are adapted to fit the threads on the pump barrel 12. However, the packing head 64 could be attached to the barrel 12 by welding or other means that are air tight. The packing gland 66 is also put over the shaft and fit with in the packing head 64. Lastly the packing nut 62 is put over the shaft 60 and threadly advance inward towards the packing head 64. When the packing nut 62 is threadly advanced there a pressure form upon the packing gland 66 forcing the packing gland to expand against the shaft 60 of the pump 14 forming an effective seal. As I pointed out above the packing nut 62 and the packing head 64 have conic sections that press against the packing gland 66. These conic sections place a pressure on the packing gland 66 not only causing it to expand but also push it towards the shaft 60 forming even a better seal. As the packing gland 66 wears around the shaft 10 the packing nut 62 can be advance even further against the packing head 64 and the conic sections will force the packing gland 66 against the shaft of the pump 14. In the prior art the packing gland was advance towards the shaft of the pump by putting vertical pressure on the packing gland and causing it to expand. However, in my invention the packing gland 66 is not only compressed vertically but it is also forced by the connical sections toward the shaft 10 of the pump 14. This makes the seal more effective and causes the packing gland 64 to last longer.

Near the end of the shaft 60 of the pump 14 is the piston disk 80. This piston disk 80 fits up with sufficient tightness against the barrel of the pump that a vaccume is created below the piston 80 when the handle 10 of the pump 14 is lifted. When the handle 10 of the pump 14 is again forced down liquid is transferred by restricted orifices in the piston disk 80 to the chamber above the piston disk 80.

The operation of the pump 14 depends on a small vaccume developed between the liquid level and the piston disk 80 created by the up lift of the handle 10. This results in a small pressure in the barrel 10 which is relieved by the lifting of the ball 56 of the check valve and the drawing up of liquids into the pump. Pushing the handle 10 down again causes the liquids to be forced through the restriction orifices in the piston disk 80 and into the pump barrel 10 above the piston 80. Next uplift to the handle 10 dispense the liquid to the pump spout 16. The pump 14 is self priming.

Although one embodiment of this invention has been illustrated and described, it is to be understood by one skilled in the art that numerous changes and modifications can be carried out specifically in the embodiment shown and described with out disparting from the spirit and scope of the claim invention. Accordingly, that scope of the invention is intendant to be limited only by the scope of the claims.

What is claimed is:

1. A safety hand pump comprising:

a. a means for pumping liquids by hand from a reservoir container to a receptacle container; and b. a means for stopping the spread of fire through the pumping means adapted to fit within the pumping means; and c. a means for grounding the pump, and the receptacle container and said means for grounding is attached to the pump and is releasably attached to the receptacle container and the means for grounding prevents static build up on the pump and the receptacle container.

2. A safety hand pump as in claim 1 wherein:

a. the means for pumping comprising:

1. a cylindrical barrel with an upper and lower end; and, 2. a spout located on the upper end of the cylindrical barrel; and, 3. a means for pumping liquids into the barrel and out through the spout; and, 4. the means for stopping the spread of fire is a flame arrestor inside the spout.

3. a safety pump as in claim 1 further comprising:

a. a second means for grounding which grounds the reservoir container and said second means for grounding is attached to the pump and is releasably attached to the reservoir container and the second means for grounding prevents static build up on the reservoir container.

4. a safety hand pump as in claim 1 wherein:

a. the means for pumping has an outer surface; and b. the means for grounding comprises.

(1) a wire attached to the pump; and, (2) a means for releasably attaching the wire to a ground; and, (3) a second wire attached to the pump; and, (4) a second means for releasably attaching the second wire to the receptacle container; and, (5) the outer surface of the pump is made out of a conductive substance.

5. a safety hand pump as in claim 4 further comprising:

(a). a second means for grounding comprises a bung adaptor made out of a conductive substance that is threaded adapted to screw into the bung on the receptacle container and the bung adaptor has an opening in the center of sufficient size for the pump to pass through and the pump is secured to the bung adaptor by a thumb screw made out of conductive substance that is passed through a threaded opening in the bung adaptor and is tighten against the pump whereby any static build up on the receptacle container will be conducted through the bung adaptor to the pump and through the pump to the wire attached to the pump which is releasably attached to a ground.

6. a safety hand pump as in claim 4 wherein:

a. the means for pumping comprises:

(1) a cylindrical barrel with an upper and lower end; and, (2) a spark located in the upper end of the cylindrical barrel; and, (3) a means for pumping liquids into the barrel and out through the spout; and, b. the means for stopping the spread of fire is a flame arrestor inside the spout.

7. a safety hand pump as in claim 1 comprising:

a. the means for pumping is made out of steel, polytetrafluoroethylene and glass.

8. a hand pump comprising:

a. a cylindrical barrel with an upper and lower end; and, b. a spout located on the upper end of the cylindrical barrel; and, c. a means for pumping liquids into the barrel and out to the spouts; and, d. a means for pumping is driven by a shaft which passes into the cylindrical barrel; and, e. a mechanism for making an air tight seal around said shaft comprising:

(1) A packing gland with a top and bottom and with a channel through its center which has an diameter slightly larger than the shaft and the packing gland's top and bottom edges are beveled; and, (2) A packing head with a top and bottom and a channel through its center, said channel at the bottom of the packing head is slightly larger then the diameter of the shaft and said channel at the top of the packing head is a size large enough that the packing gland can fit within said channel; and, (3) Said channel is threaded at the top and in between the threaded top and the bottom the channel becomes conically shaped tapering towards the bottom; and, (4) A packing nut having a threaded outer surface and adapted to fit within the packing head, the packing nut having a channel in the center with a diameter slightly larger then the shaft, and said channel at the bottom is conically shaped tapering towards the top of the nut; and, (5) Said packing head is fitted over said shaft and attached to the barrel of the pump in an air tight seal and then the packing gland is fitted over the shaft and is fitted within the packing head and then the packing nut is fitted over the shaft and thready advance within the packing head, the conically shaped channel of the packing nut and the packing head apply pressure to the packing gland forcing it towards the shaft, and therefore forming an air tight seal around the shaft.

9. a hand pump as in claim 8 wherein:

a. the packing gland is made out of, polytetrafluoroethylene.

10. a hand pump as in claim 8 further comprising:

a. a means for stopping a spread of fire through the pump adapted to fit within the pump; and, b. a means for grounding the pump, and the receptacle container and said means for grounding is attached to the pump and is releasably attached to the receptacle container and the means for grounding prevents static build up on the pump and receptacle container.

* * * * *